US012629793B2

(12) United States Patent
Numata

(10) Patent No.: US 12,629,793 B2
(45) Date of Patent: May 19, 2026

(54) POWER TOOL

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 364 days.

(21) Appl. No.: 18/244,651

(22) Filed: Sep. 11, 2023

(65) Prior Publication Data

US 2024/0157500 A1 May 16, 2024

(30) Foreign Application Priority Data

Nov. 15, 2022 (JP) ..... 2022-182810

(51) Int. Cl.
*B24B 47/26* (2006.01)
*B24B 23/02* (2006.01)

(52) U.S. Cl.
CPC ..... *B24B 47/26* (2013.01); *B24B 23/028* (2013.01)

(58) Field of Classification Search
CPC ..... B24B 23/028; B24B 23/02; B24B 47/26; B24B 41/02; B24B 41/04; B24B 47/12; B24B 55/00; B24B 41/007; B23Q 11/0092; B25F 5/001; F16D 51/42; F16D 49/18; F16D 65/10
USPC ..... 451/359, 344
See application file for complete search history.

(56) References Cited

U.S. PATENT DOCUMENTS 1,672,314 A * 6/1928 Hall ..... F16D 49/16 188/171
2,174,529 A * 10/1939 Proctor ..... G03B 21/48 352/182
2,391,074 A * 12/1945 Schnell ..... F16D 49/16 188/75
2,491,850 A * 12/1949 Browning ..... F16D 49/16 188/75
3,135,881 A * 6/1964 Fresard ..... A61C 17/225 310/68 R
2013/0023189 A1* 1/2013 Numata ..... B23Q 11/0092 451/344
2014/0069756 A1* 3/2014 Esenwein ..... B24B 23/028 188/323
2020/0189066 A1* 6/2020 Qu ..... B24B 23/028
2020/0361057 A1 11/2020 Shibata et al.
2022/0118596 A1* 4/2022 Hatakeyama ..... B25F 5/02

* cited by examiner

*Primary Examiner* — Monica S Carter
*Assistant Examiner* — Kent N Shum
(74) *Attorney, Agent, or Firm* — Oliff PLC

(57) ABSTRACT

A power tool includes a brake assembly including a swing member swingable about a pivot at an axial center decentered from a center of a brake member, a press member held by the swing member to come in contact with the brake member in response to the swing member swinging, and a spring having an axial center at a second decentered position opposite to the pivot with the center of the brake member between the axial center and the pivot. The axial center is on a second line orthogonal to a first line extending through the center of the brake member and the pivot. The spring has an elastic movable end in contact with an end of the swing member to urge the swing member to a position at which the press member is in contact with the brake member with a switch being in an off state.

20 Claims, 13 Drawing Sheets

UP
LEFT
RIGHT
DOWN
1
2
4
50
41
84
51
75
76B
2b
85
78
14
87
88
80
101
99
102
81
97
98
90
77
88
87
14
78
85
2a
76A
4
50
41
84
2
1

POWER TOOL

CROSS-REFERENCE TO RELATED APPLICATIONS

This application claims the benefit of priority to Japanese Patent Application No. 2022-182810, filed on Nov. 15, 2022, the entire contents of which are hereby incorporated by reference.

BACKGROUND

1. Technical Field

The present disclosure relates to a power tool such as a grinder that rotates a tip tool.

2. Description of the Background

A power tool such as a grinder uses a tip tool such as a grinding disc and rotates the tip tool to perform an operation. Such a power tool includes a brake assembly to stop inertial rotation of the tip tool in a short time when the operation is complete. An example brake assembly described in Japanese Patent No. 6953252 applies braking to an output shaft in a motor using a brake plate at the rear end of the output shaft. The brake plate is pressed by brake shoes, which are urged by coil springs. To use the tool, an operable member such as a paddle switch is pressed to turn on the tool. A lever then rotates in cooperation with the operable member to cause the brake shoes to be separate from the brake plate, releasing the braking. When the operable member is released from being pressed, the switch is turned off to cause the brake shoes to press the brake plate. This applies braking.

BRIEF SUMMARY

The surfaces of the brake shoes come in contact with the rotating brake plate during braking. The brake shoes thus wear over time, decreasing a braking force and increasing the stop time of the tip tool.

One or more aspects of the present disclosure are directed to a power tool that can reduce a decrease in a braking force and prevent a delay in the stop time of a tip tool when a brake shoe in the power tool wears over time.

A first aspect of the present disclosure provides a power tool, including:

- a housing;
- a switch in the housing, the switch being operable to be turned on or off in response to an operation on an operable member;
- a rotational shaft rotatable in response to an operation to turn on the switch;
- a brake member having a circular outer shape and coaxially fixed to the rotational shaft; and
- a brake assembly configured to apply braking to the rotational shaft with the switch being in an off state and to release the braking applied to the rotational shaft in response to the operation on the operable member to turn on the switch, the brake assembly including
  - a swing member swingable about a pivot at a first decentered position decentered from a center of the brake member,
  - a press member held by the swing member, the press member being configured to come in contact with the brake member in response to the swing member swinging, and

- a spring having a center at a second decentered position opposite to the pivot with the center of the brake member between the center and the pivot, the center being on a second line orthogonal to a first line extending through the center of the brake member and the pivot, the spring having a movable end being elastic and in contact with an end of the swing member, the spring being configured to urge the swing member to a position at which the press member is in contact with the brake member with the switch being in the off state.

The power tool according to the above aspect of the present disclosure can reduce a decrease in a braking force and prevent a delay in the stop time of a tip tool when the press member in the power tool wears over time.

DETAILED DESCRIPTION

Embodiments of the present disclosure will now be described with reference to the drawings.

Figure 1:
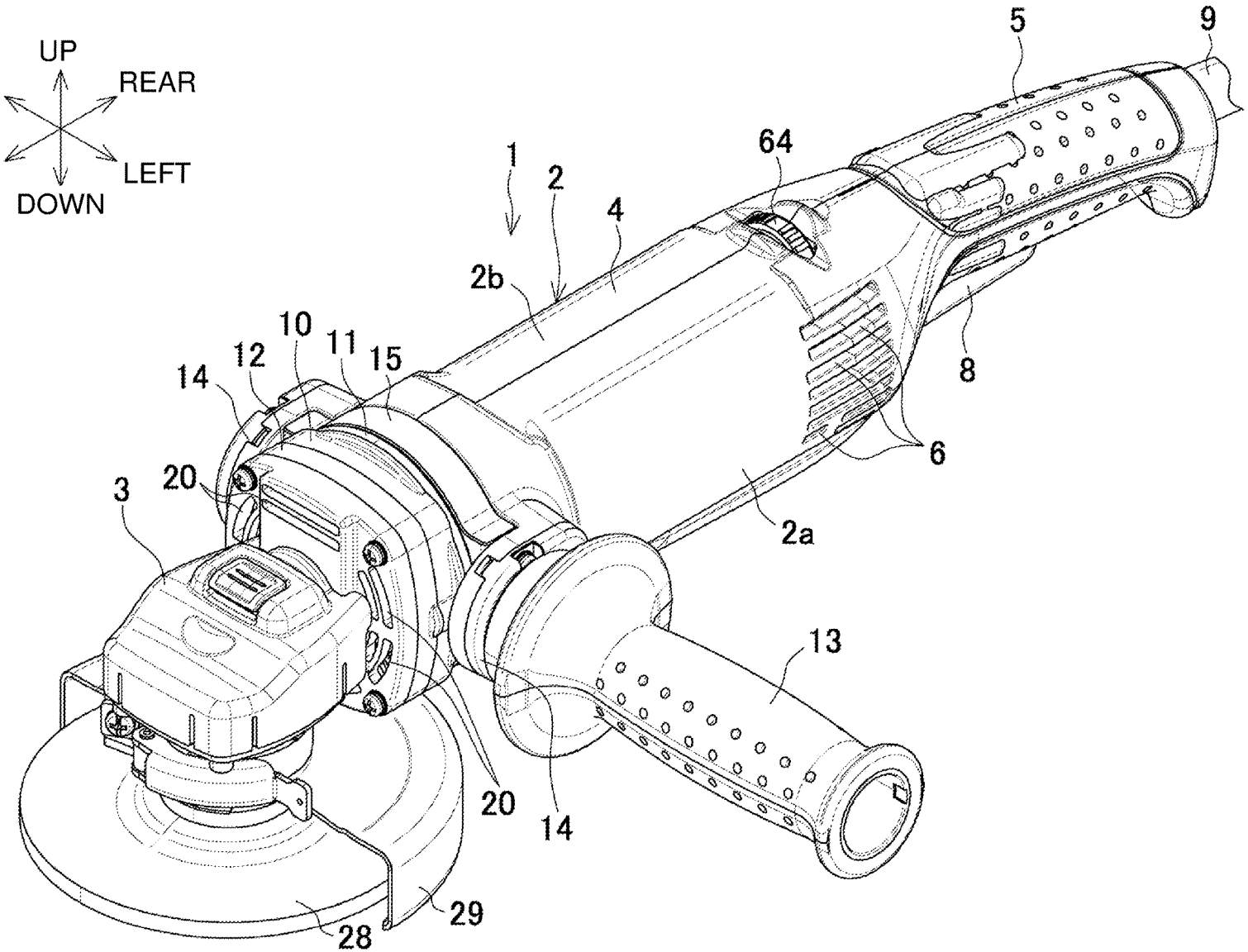
FIG. 1 is a perspective view of a grinder.
Figure 2:
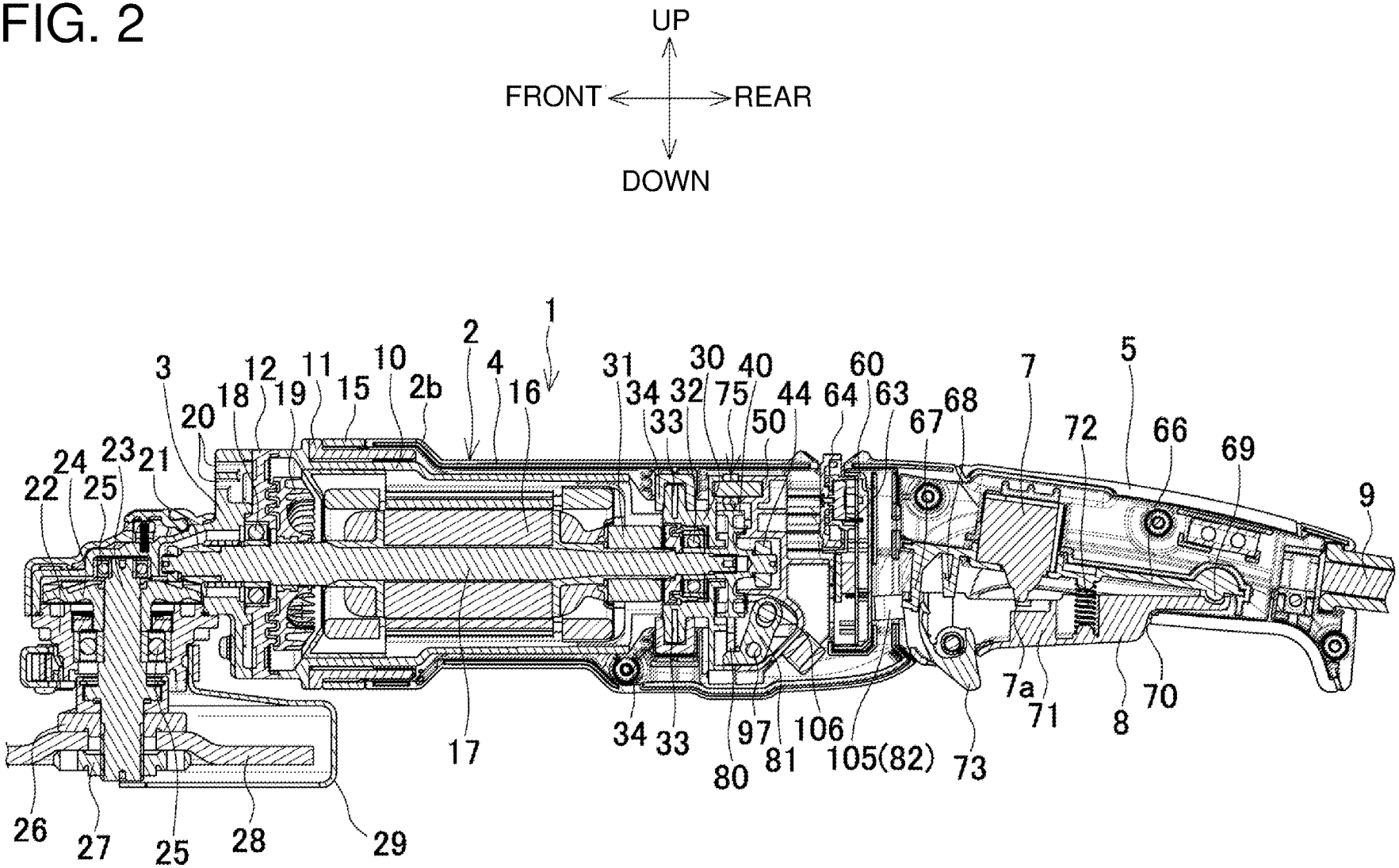
FIG. 2 is a longitudinal central sectional view of the grinder in a switch-off state.

FIG. 1 is a perspective view of a grinder as an example power tool. FIG. 2 is a longitudinal central sectional view of the grinder.

A grinder 1 includes a cylindrical main housing 2 extending in the front-rear direction. The main housing 2 is formed from a resin. The main housing 2 receives a gear housing 3 formed from metal at its front. The main housing 2 includes a pair of left and right housing halves 2*a* and 2*b* fastened together with screws in the lateral direction. The main housing 2 includes a body 4 at the front and a grip 5 at the rear. The body 4 has multiple inlets 6 in its left and right rear side surfaces. The inlets 6 are elongated in the front-rear direction. The grip 5 has a smaller diameter than the body 4. The grip 5 obliquely extends downward from a position decentered upward from the axis of the body 4 toward the rear. The grip 5 includes a switch 7 and a switch lever 8. A power cable 9 is connected to the rear end of the grip 5.

A motor housing 10 is held in a front portion of the body 4 with a rubber sleeve 11 in between. The gear housing 3 is fastened to the motor housing 10 with screws from the front with a gear housing cover 12 in between. Mounts 14 for receiving a side handle 13 are located on the left and right of the body 4. A fixing ring 15 externally mounted on the rubber sleeve 11 is located at the front of the main housing 2 and inward from the mounts 14. The mounts 14 are fastened to the fixing ring 15 with screws.

The motor housing 10 is formed from a resin. The motor housing 10 accommodates a motor 16. The motor 16 is a commutator motor. The motor housing 10 accommodates the motor 16 with a rotational shaft 17 extending in the front-rear direction. The rotational shaft 17 includes a front portion protruding into the gear housing 3 through the gear housing cover 12. The gear housing cover 12 receives a bearing 18 for supporting the rotational shaft 17. Behind the gear housing cover 12, a fan 19 is fixed to the rotational shaft 17. The gear housing 3 has, in its front surface, multiple outlets 20 connecting with the inside of the motor housing 10.

A bevel gear 21 is mounted on the front end of the rotational shaft 17 in the gear housing 3. The gear housing 3 receives a bearing box 22 in its lower portion. A spindle 23 extends in the vertical direction inside the gear housing 3 and the bearing box 22. The spindle 23 includes a bevel gear 24 in its upper portion. The bevel gear 24 meshes with the bevel gear 21 on the rotational shaft 17. The spindle 23 is axially supported by upper and lower bearings 25 held in the gear housing 3 and the bearing box 22. The spindle 23 has its lower end protruding downward from the bearing box 22. The lower end of the spindle 23 can receive a tip tool 28 such as a grinding disc in a detachable manner with an inner flange 26 and a lock nut 27. The bearing box 22 receives a wheel cover 29 covering a rear upper portion and a rear portion of the tip tool 28.

Figure 3:
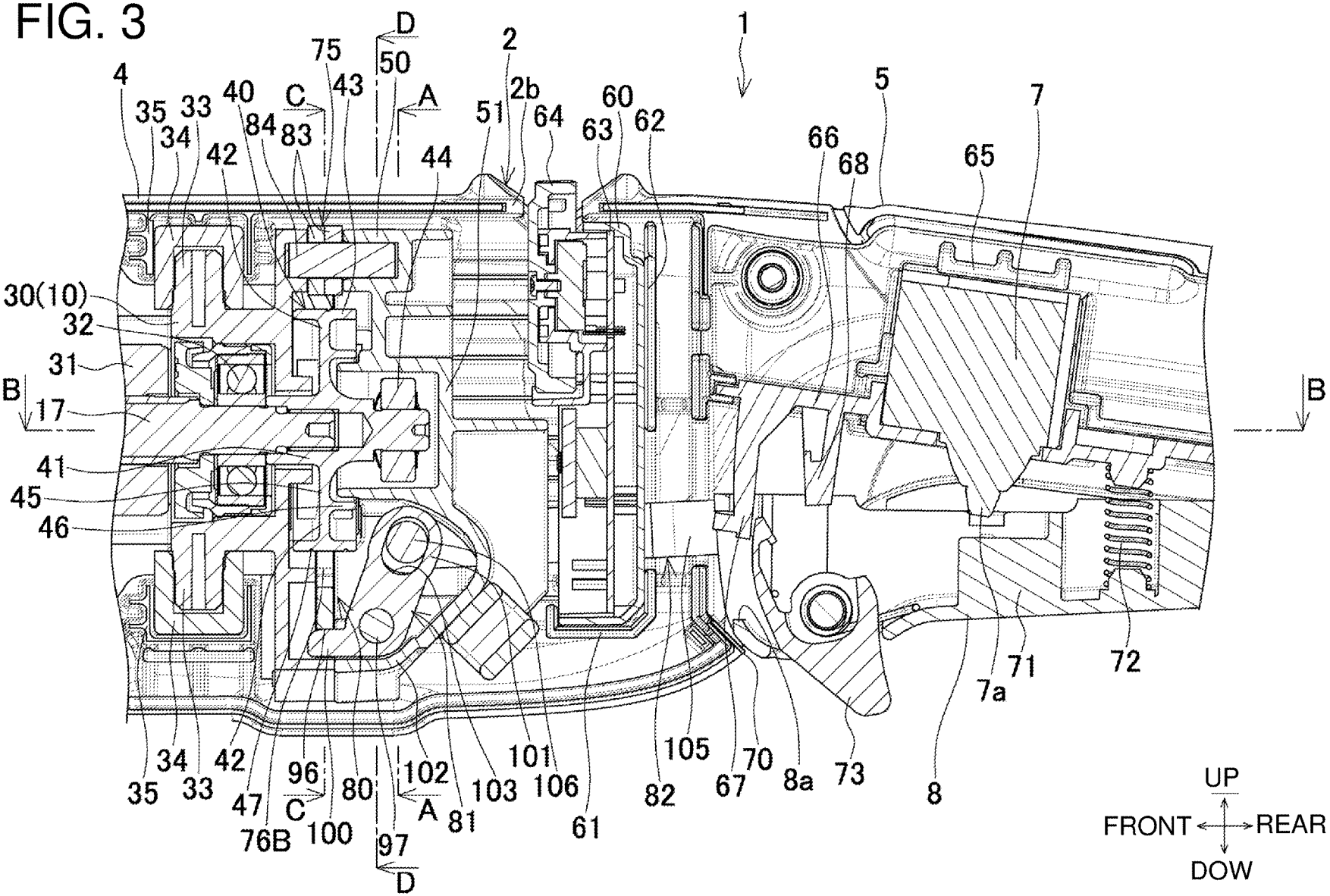
FIG. 3 is an enlarged view of a brake assembly in FIG. 2.
Figure 4:
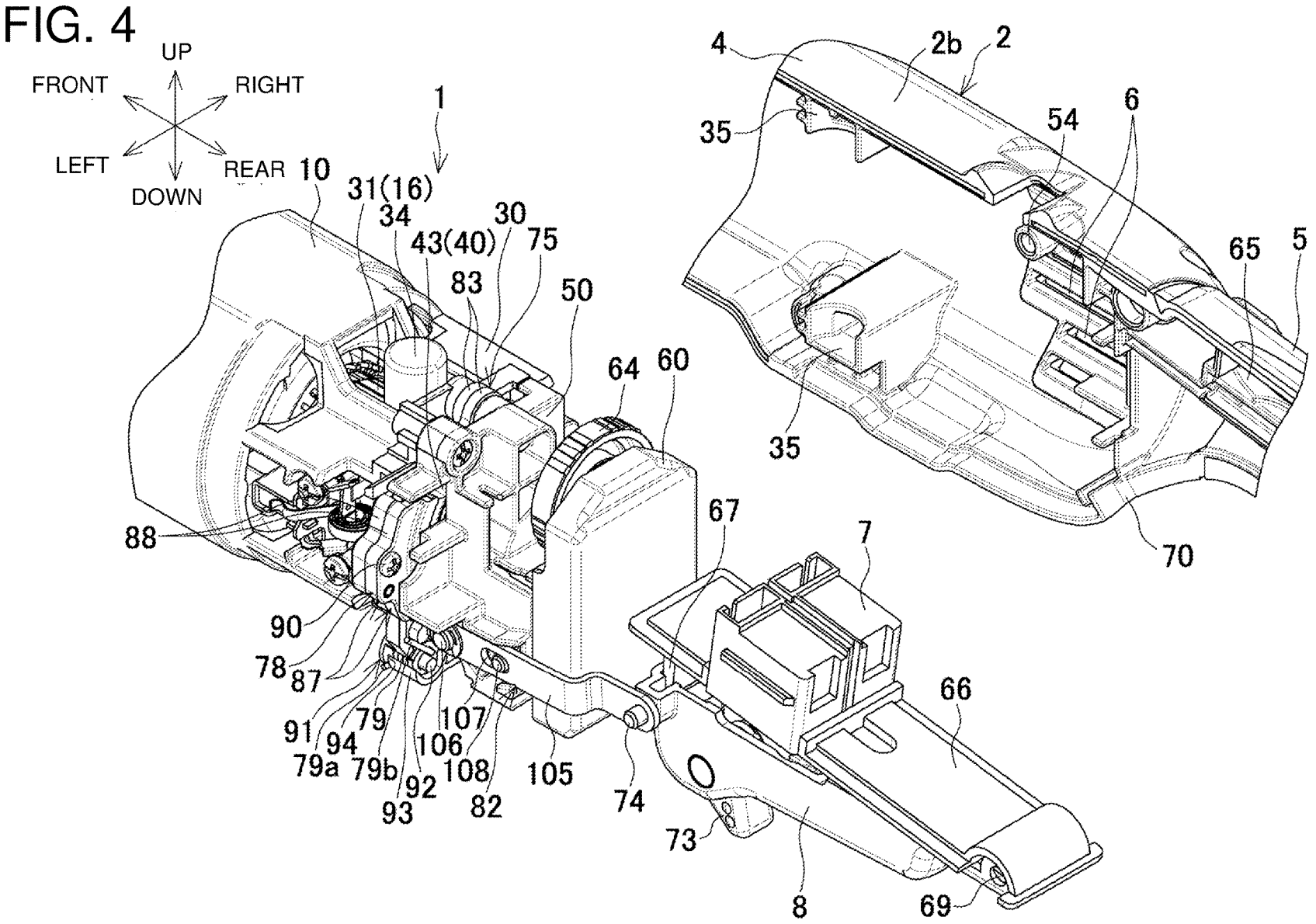
FIG. 4 is an exploded perspective view of the brake assembly and a right housing half as viewed from the rear.
Figure 5:
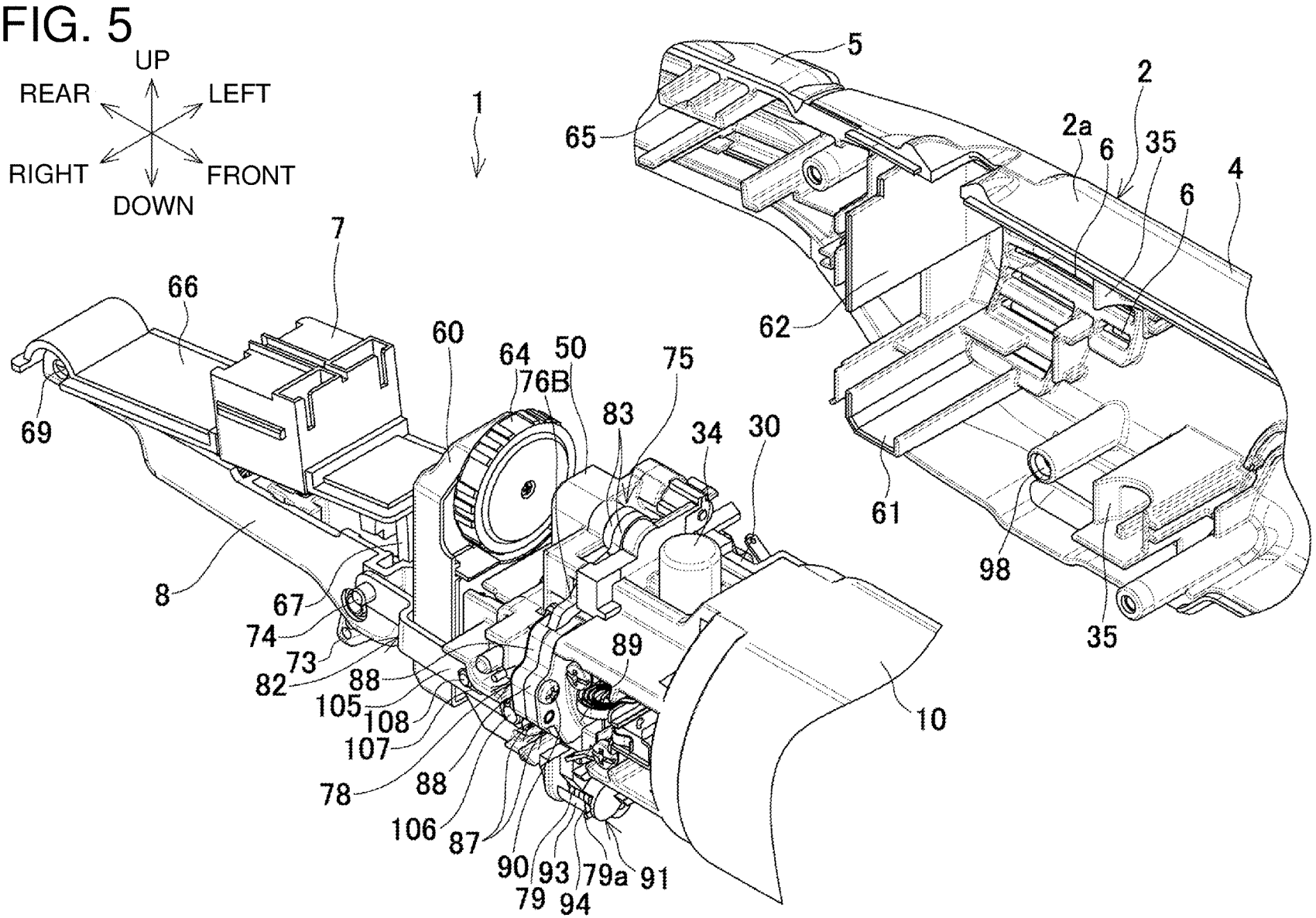
FIG. 5 is an exploded perspective view of the brake assembly and a left housing half as viewed from the front.

As shown in FIG. 3, a bearing retainer 30 is integral with a rear portion of the motor housing 10. The rotational shaft 17 protruding rearward from a commutator 31 is supported by a bearing 32 held by the bearing retainer 30. The bearing retainer 30 includes a pair of upper and lower support projections 33. The pair of support projections 33 are coaxial in the vertical direction perpendicular to the axis of the rotational shaft 17. Each support projection 33 receives a rubber ring 34 as a cap. As also shown in FIGS. 4 and 5, holders 35 are located on the upper and lower inner surfaces of the left and right housing halves 2*a* and 2*b*. The holders 35 protrude laterally inward to hold the upper or lower rubber ring 34 at the middle. Thus, the motor housing 10 is elastically supported in the main housing 2 with the rubber sleeve 11 at the front and the rubber rings 34 at the rear.

Figure 6:
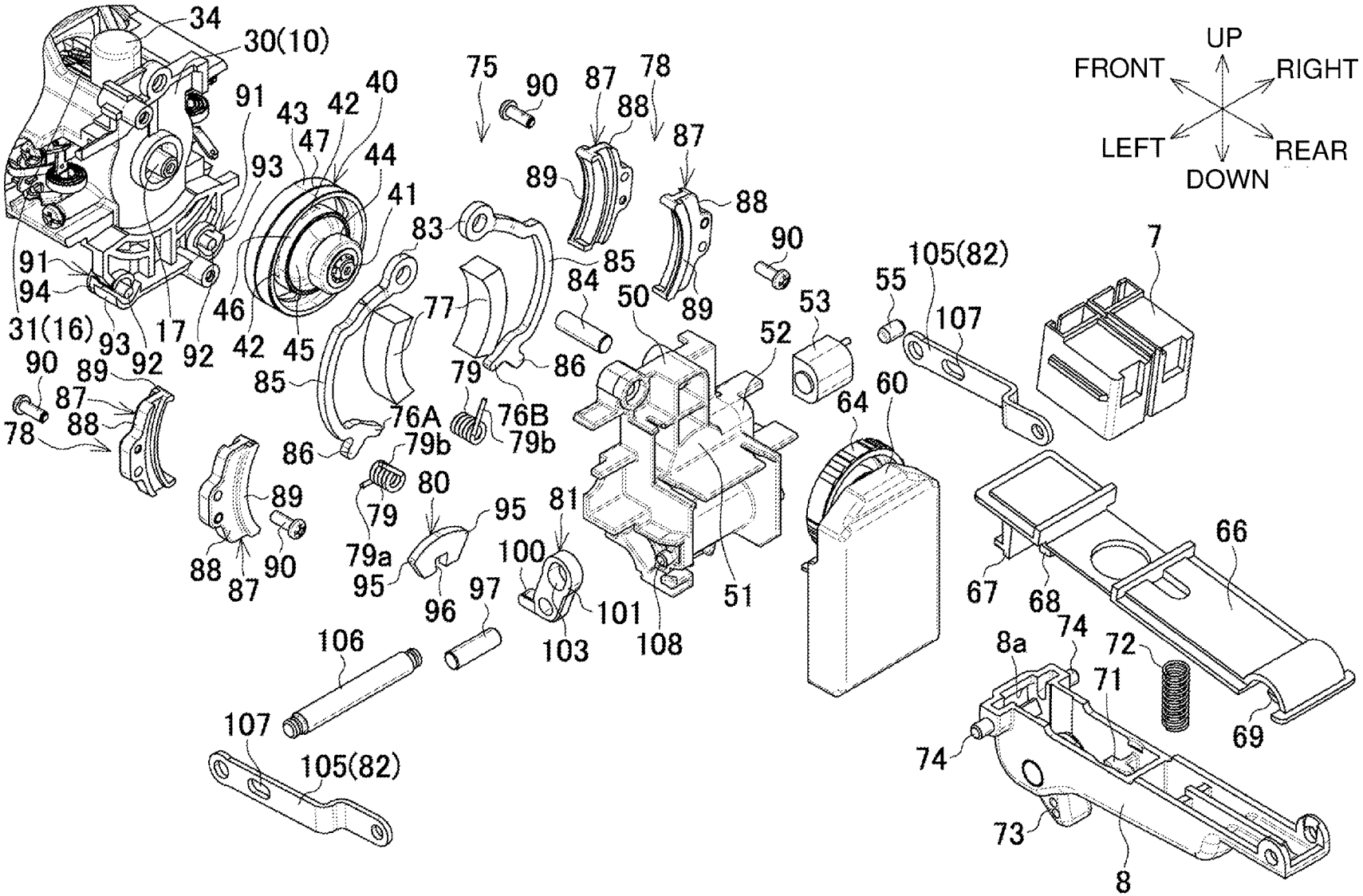
FIG. 6 is an exploded perspective view of the brake assembly.

The rotational shaft 17 has its rear end extending rearward through the bearing retainer 30. Behind the bearing retainer 30, a brake drum 40 is fixed to the rear end of the rotational shaft 17. The brake drum 40 includes a hub 41, multiple spokes 42, and a rim 43, as also shown in FIG. 6. The hub 41 is screwed onto the rotational shaft 17 from the rear and is coaxially and integrally connected to the rotational shaft 17. The hub 41 is tightened in a direction opposite to the rotation direction of the rotational shaft 17. The hub 41 receives a disk-shaped magnet sleeve 44 attached to its rear end. A disk 45 is mounted on the outer circumference of the hub 41. The disk 45 includes a circular rib 46 extending rearward on its outer circumference. The spokes 42 extend radially from the outer circumferential surface of the circular rib 46. The rim 43 is connected to a radially outward end of each spoke 42, is located radially outward from the disk 45, and is coaxial with the disk 45. The rim 43 is a strip ring protruding frontward and rearward from the spokes 42. The rim 43 has a spiral groove 47 on its outer circumferential surface. The groove 47 has its front and rear ends connecting to the front and rear end faces of the rim 43 and open at the end faces.

Figure 7:
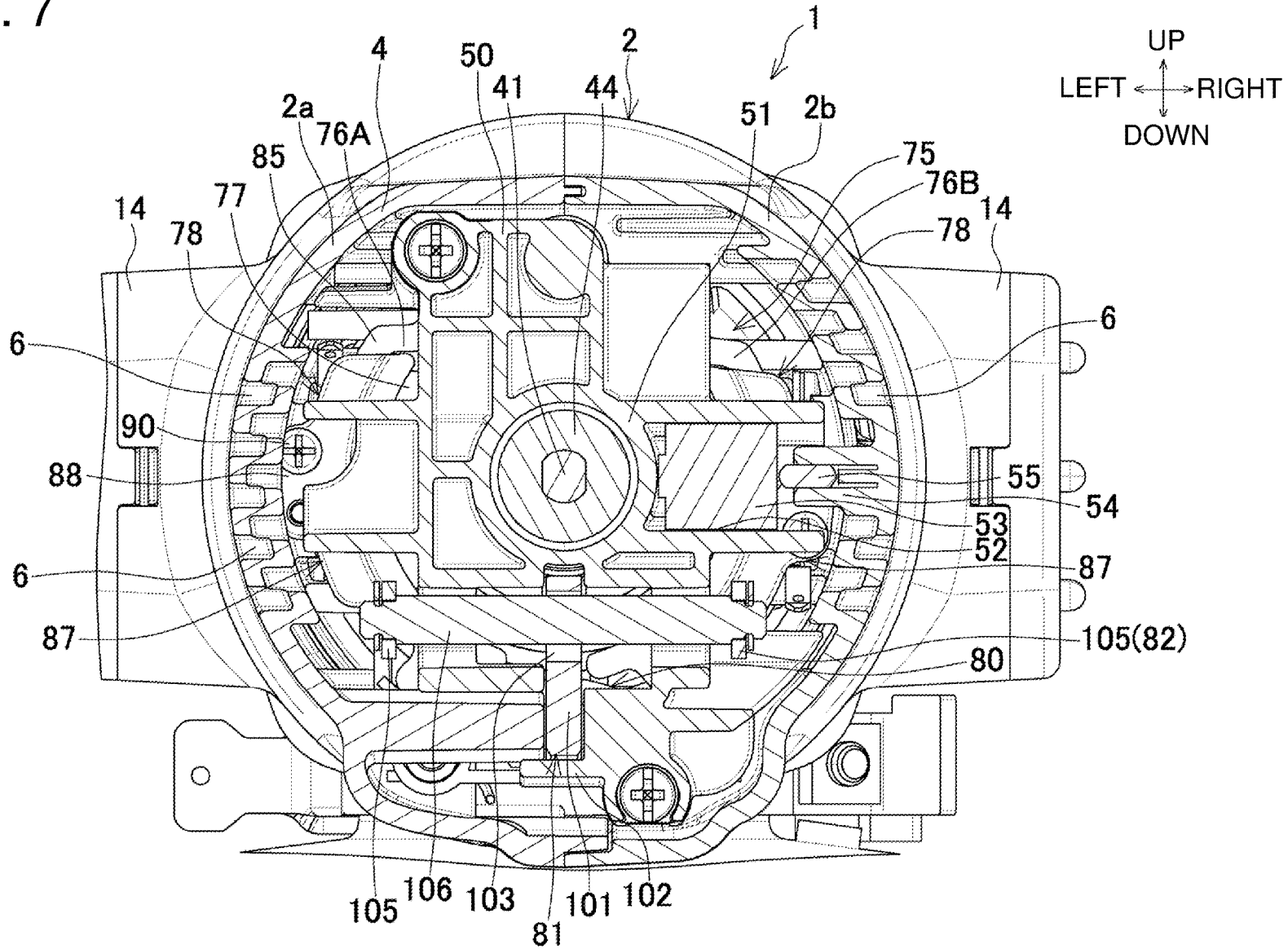
FIG. 7 is a sectional view taken along line A-A in FIG. 3.
Figure 8:
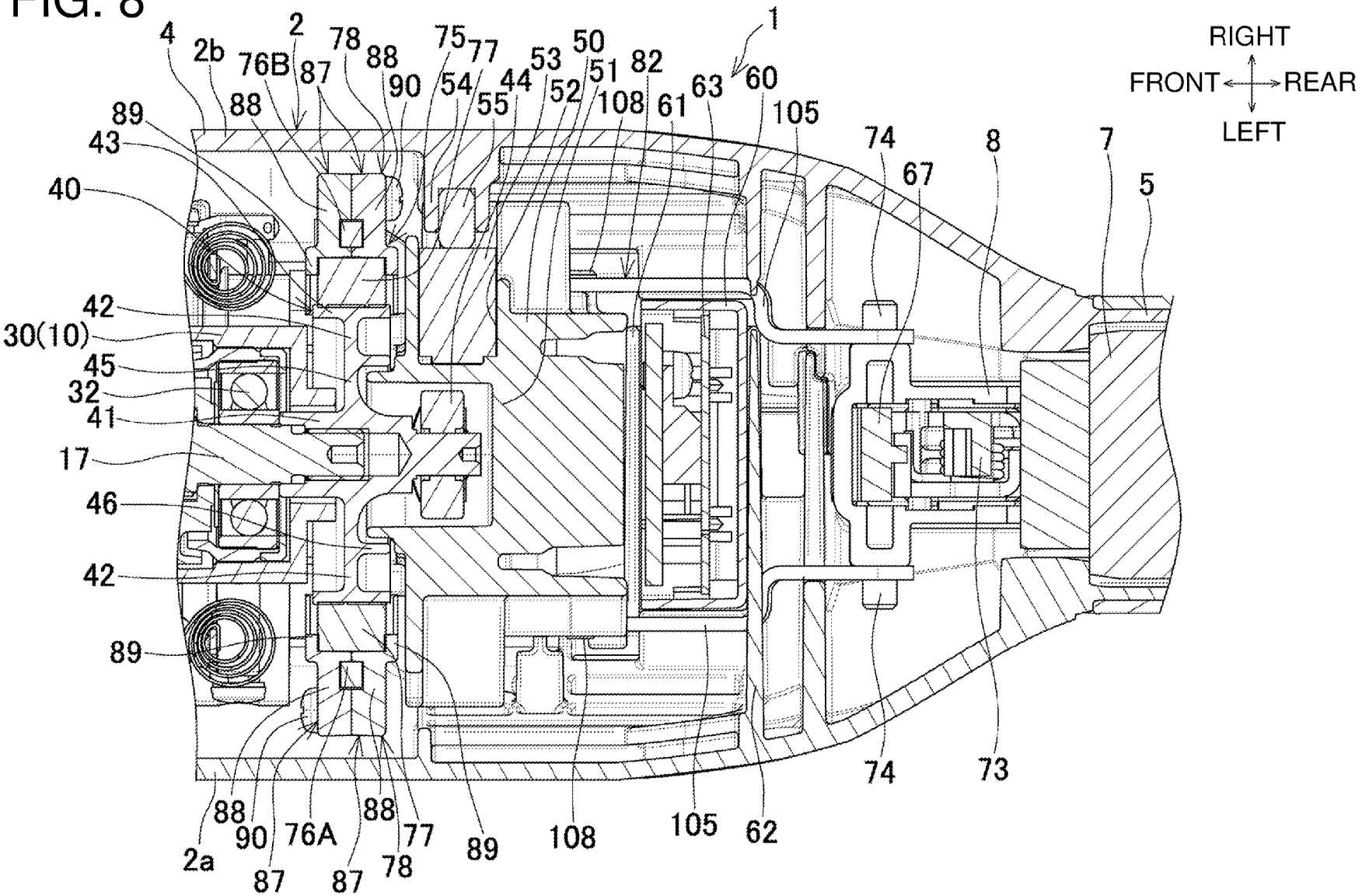
FIG. 8 is a sectional view taken along line B-B in FIG. 3.
Figure 9:
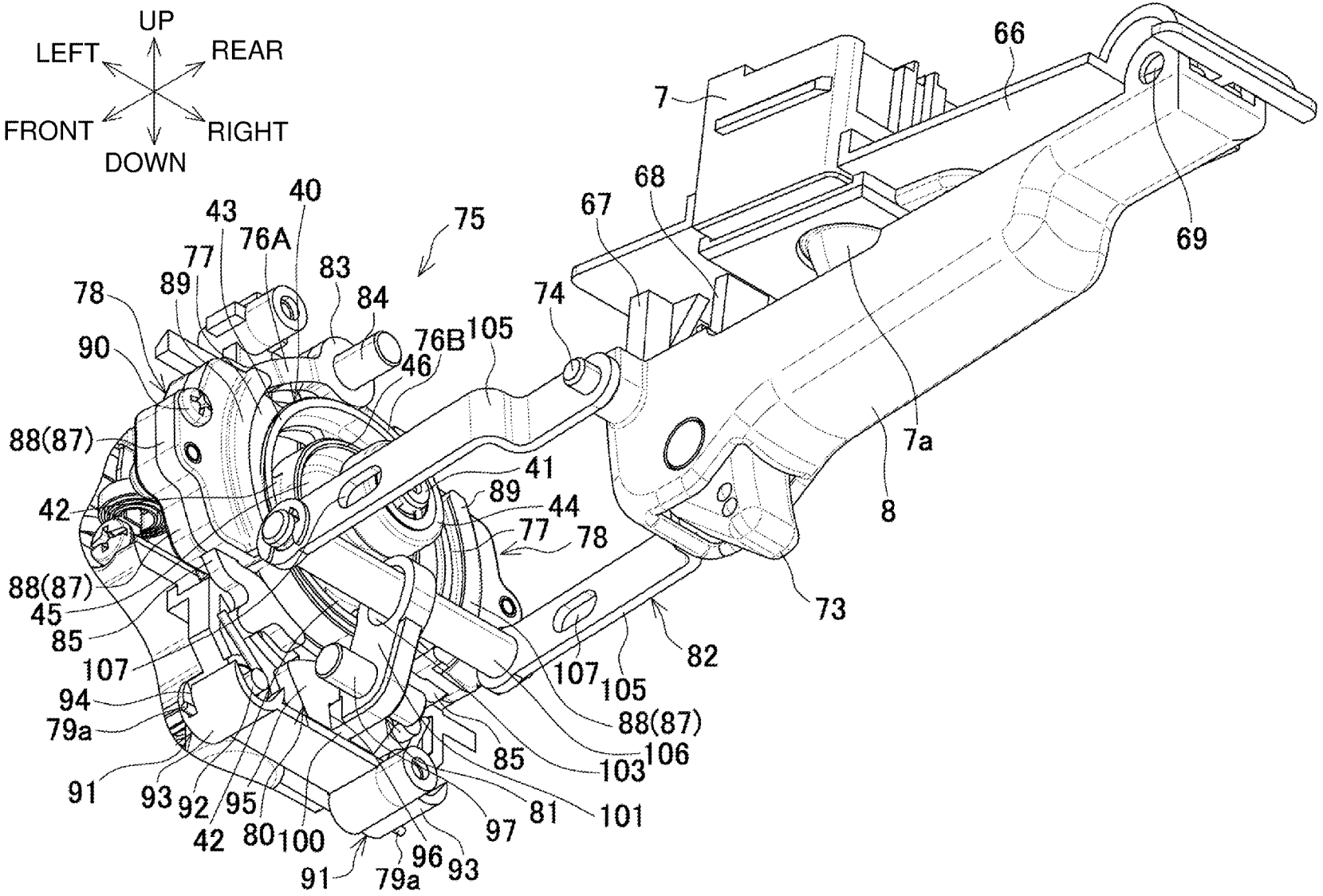
FIG. 9 is a perspective view of the brake assembly alone as viewed from below.

A coil holder 50 is located behind the brake drum 40 in the body 4. The coil holder 50 is a box extending in the vertical direction as also shown in FIG. 7. The coil holder 50 is fastened to the bearing retainer 30 with screws from the rear at two vertical positions. The coil holder 50 has a cylindrical recess 51 that is open frontward at the center as also shown in FIG. 8. The cylindrical recess 51 accommodates the rear end of the hub 41 in the brake drum 40 and the magnet sleeve 44 without contact with one another. The cylindrical recess 51 has its front end protruding inside the circular rib 46 on the hub 41. The front end of the cylindrical recess 51 overlaps the circular rib 46 without contact with each other in the radial direction.

The coil holder 50 includes a compartment 52 for a pickup coil 53 on the right of the cylindrical recess 51. The compartment 52 accommodates the pickup coil 53 with a sensing surface facing leftward. The sensing surface is located immediately on the right of the magnet sleeve 44. The right housing half 2*b* includes a boss 54 protruding leftward on its inner surface. The boss 54 holds a rubber pin 55 at its distal end. The rubber pin 55 is in contact with the right side surface of the pickup coil 53 to press the pickup coil 53 against the left inner surface of the compartment 52.

A controller 60 is located behind the coil holder 50 in the body 4. The controller 60 is held vertically at the middle in the lateral direction on a lower receiving rib 61 and a rear receiving rib 62 protruding from an inner surface of the left housing half 2*a*. The controller 60 includes a control circuit board 63 inside. An adjustment dial 64 is located on an upper front surface of the control circuit board 63. As shown in FIGS. 1 to 3, an upper portion of the adjustment dial 64 is exposed above the main housing 2. The rotational speed of the motor 16 can be adjusted by rotating the adjustment dial 64.

The switch 7 is held in an upper portion of the grip 5 with a button 7*a* facing downward. Holding ribs 65 holding an upper portion of the switch 7 are located on the inner surfaces of the left and right housing halves 2*a* and 2*b*. A switch base 66 holding a lower portion of the switch 7 is held in the grip 5. The switch base 66 is a plate extending in the front-rear direction along the slope of the grip 5. The button 7*a* protrudes downward through the switch base 66. A stopper tab 67 and an engagement tab 68 are arranged in the front-rear direction in a front portion of the switch base 66. The stopper tab 67 and the engagement tab 68 extend downward. A shaft 69 protrudes leftward and rightward from a lower rear surface of the switch base 66.

The switch lever 8 extends in the front-rear direction under the switch base 66. The switch lever 8 has its rear end connected to the shaft 69 in the switch base 66 in a rotatable manner. The switch lever 8 has a front portion exposed downward through an opening 70 in a lower surface of the grip 5. The switch lever 8 includes a pressing portion 71 below the button 7*a*. The switch lever 8 has an engagement hole 8*a* in its front surface as shown in FIGS. 3 and 6. The engagement hole 8*a* receives the lower end of the stopper tab 67. The switch lever 8 is swingable vertically between an upper position and a lower position. With the switch lever 8 at the upper position, the lower edge of the engagement hole 8*a* comes in contact with the lower end of the stopper tab 67 to cause the pressing portion 71 to press the button 7*a*. The switch 7 is thus turned on. With the switch lever 8 at the lower position, the upper edge of the engagement hole 8*a* is engaged with the lower end of the stopper tab 67 to cause the pressing portion 71 to separate from the button 7*a*. The switch 7 is thus turned off. A coil spring 72 is held between the switch base 66 and the switch lever 8. The coil spring 72 urges the switch lever 8 to the lower position in a normal state. The switch lever 8 includes a lock-on lever 73 at its lower front end. With the switch lever 8 at the upper position, the lock-on lever 73 is rotated to be engaged with the engagement tab 68 to lock the switch lever 8 at the upper position. A pair of connecting pins 74 protrude laterally outward from the left and right front side surfaces of the switch lever 8.

The body 4 accommodates a brake assembly 75. The brake assembly 75 includes, as shown in FIGS. 6, 8, 9, and 10, the brake drum 40, a pair of brake arms 76A and 76B, a pair of brake shoes 77, a pair of shoe holders 78, a pair of torsion springs 79, a wedge plate 80, a front link 81, and a rear link 82.

The brake arms 76A and 76B are located radially outward from the brake drum 40. The brake arms 76A and 76B are semicircular as viewed from the front. The brake arms 76A and 76B are symmetric about the rotational shaft 17 and the hub 41. The left brake arm 76A has an upper portion bending to the rear. The right brake arm 76B has an upper portion bending to the front. The left and right brake arms 76A and 76B are thus located on the same plane perpendicular to the axis of the brake drum 40, except their upper portions.

The brake arms 76A and 76B each has a pivot portion 83 as a ring at the upper end. The pivot portions 83 axially overlap each other in the front-rear direction. The pivot portions 83 aligned in the front-rear direction receive a pivot pin 84 extending in the front-rear direction. As shown in FIG. 3, at a position decentered upward from the axis of the rotational shaft 17, the pivot pin 84 has a front end supported on the rear surface of the bearing retainer 30 and a rear end supported on the front surface of the coil holder 50. The brake arms 76A and 76B are thus supported in a manner swingable leftward and rightward about the pivot pin 84. The brake arms 76A and 76B each have, at the middle in the circumferential direction, a raised portion 85 raising outward to the left or to the right in an arc. The lower ends of the brake arms 76A and 76B are semicircular and rounded as viewed from the front. The brake arms 76A and 76B each has a protrusion 86 at the lower end. Each protrusion 86 protrudes radially outward. Each protrusion 86 has a distal end that is semicircular and rounded as viewed from the front.

The brake shoes 77 are located radially inward from the raised portions 85. Each brake shoe 77 is a strip plate with a greater width than the brake arm 76A or 76B in the front-rear direction. Each brake shoe 77 is an arc along the outer circumference surface of the rim 43 on the brake drum 40.

The shoe holders 78 are located on the raised portions 85. Each shoe holder 78 includes a pair of front and rear clamping plates 87. Each clamping plate 87 includes an outer peripheral portion 88 and an inner peripheral portion 89. The outer peripheral portions 88 hold the raised portion 85 from the front and the rear. The inner peripheral portions 89 hold, inward from the raised portion 85, the outer periphery of the brake shoe 77 from the front and the rear. Each pair of clamping plates 87 holding the corresponding raised portion 85 and brake shoe 77 have the corresponding outer peripheral portions 88 joined with an upper screw 90 from the front and a lower screw 90 from the rear. Each shoe holder 78 is thus fastened to the corresponding raised portion 85 while holding the brake shoe 77.

The pair of torsion springs 79 are located symmetrically to each other below the brake arms 76A and 76B decentered downward from the axis of the rotational shaft 17. The bearing retainer 30 includes spring holders 91 in lower left and lower right portions. Each spring holder 91 holds the corresponding torsion spring 79. Each spring holder 91 includes a pin 92 and a reception plate 93. The pin 92 protrudes rearward and extends through the torsion spring 79 from the front. The reception plate 93 is semicircular and supports the torsion spring 79 from below the pin 92. The reception plate 93 has cutouts 94 in front left and front right portions.

Figure 10:
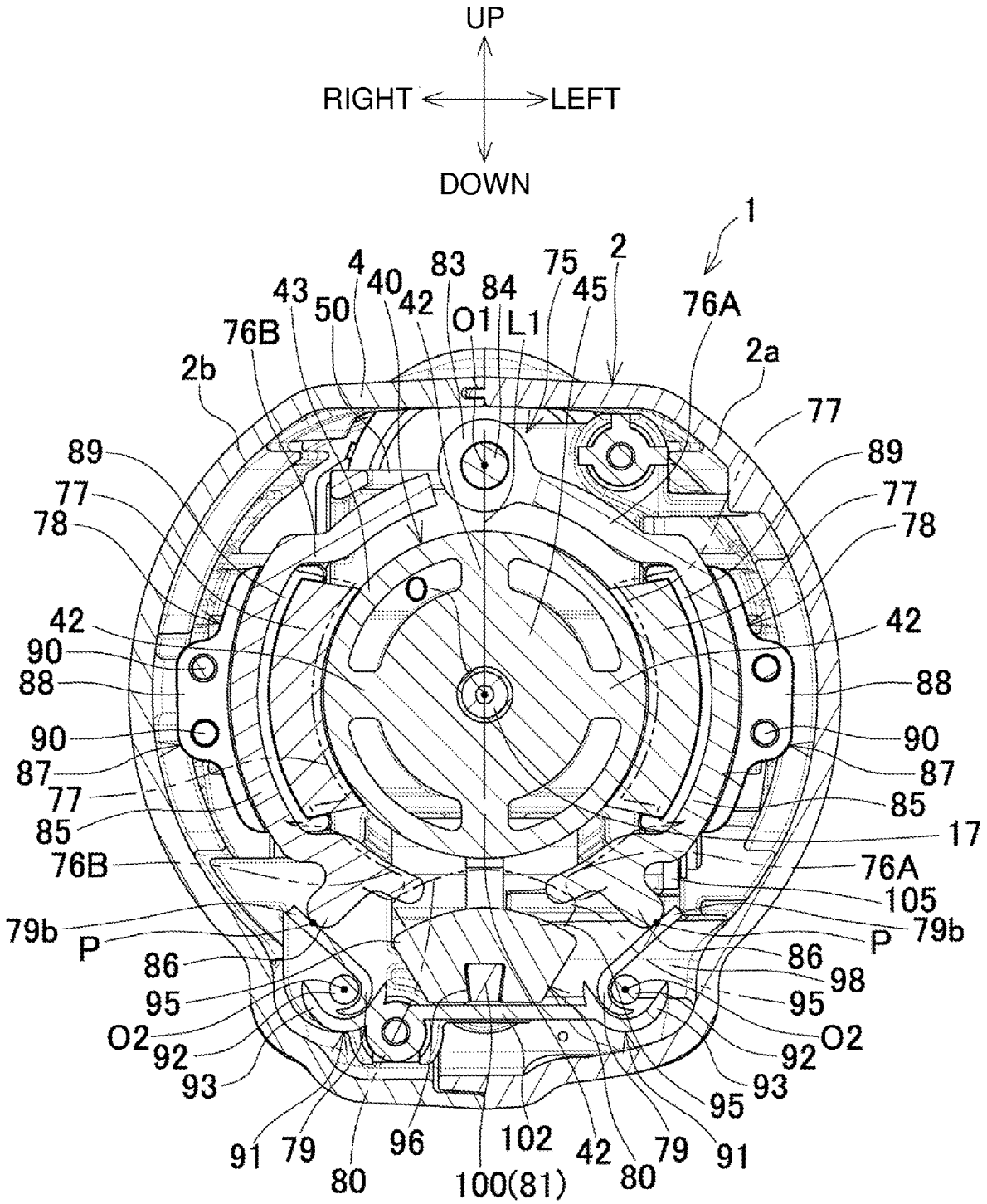
FIG. 10 is a sectional view taken along line C-C in FIG. 3.

With each torsion spring 79 extending through the corresponding pin 92 and set on the reception plate 93, a fixed end 79*a* protruding leftward or rightward from a front portion of the torsion spring 79 engages with the cutout 94. A movable end 79*b* protruding leftward or rightward from a rear portion of each torsion spring 79 tilts further laterally outward to generate an elastic force in the circumferential direction and is placed, laterally from outside, into contact with the distal end of the protrusion 86, as shown in FIG. 10. Each torsion spring 79 has an axial center O2 being closer to, as viewed laterally, a vertical line L1 extending through an axial center O1 of the pivot pin 84 and an axial center O of the brake drum 40 than a position P at which the movable end 79*b* is in contact with the protrusion 86.

The movable end 79*b* urged rotationally then presses the distal end of the protrusion 86 inward from radially outside. The left and right brake arms 76A and 76B are thus rotationally urged radially inward, and the distance between the left and right brake arms 76A and 76B decreases about the axial center O1 of the pivot pin 84. The brake shoes 77 held on the brake arms 76A and 76B with the shoe holders 78 press the outer circumference surface of the rim 43 on the brake drum 40 from the left and the right simultaneously.

The wedge plate 80 is located below the brake drum 40 and at the middle in the lateral direction. The wedge plate 80 is a symmetrical plate including extensions 95 extending laterally. The wedge plate is a fan with the center being the tallest and the height gradually decreasing toward the left and right sides to be the extensions 95. The extensions 95 are located below the lower ends of the brake arms 76A and 76B. As shown in FIG. 3, the rear surface of the bearing retainer 30 is close to or in contact with the front surface of the wedge plate 80, and the front surface of the coil holder 50 is close to or in contact with the rear surface of the wedge plate 80. The wedge plate 80 is thus restricted from moving back and forth between the bearing retainer 30 and the coil holder 50. The wedge plate 80 has a connection groove 96 at its lower middle in the lateral direction. The connection groove 96 extends through the wedge plate 80 in the front-rear direction and is open downward. The connection groove 96 has a width decreasing from its upper end, which defines the bottom of the connection groove 96, toward its lower end.

Figure 11:
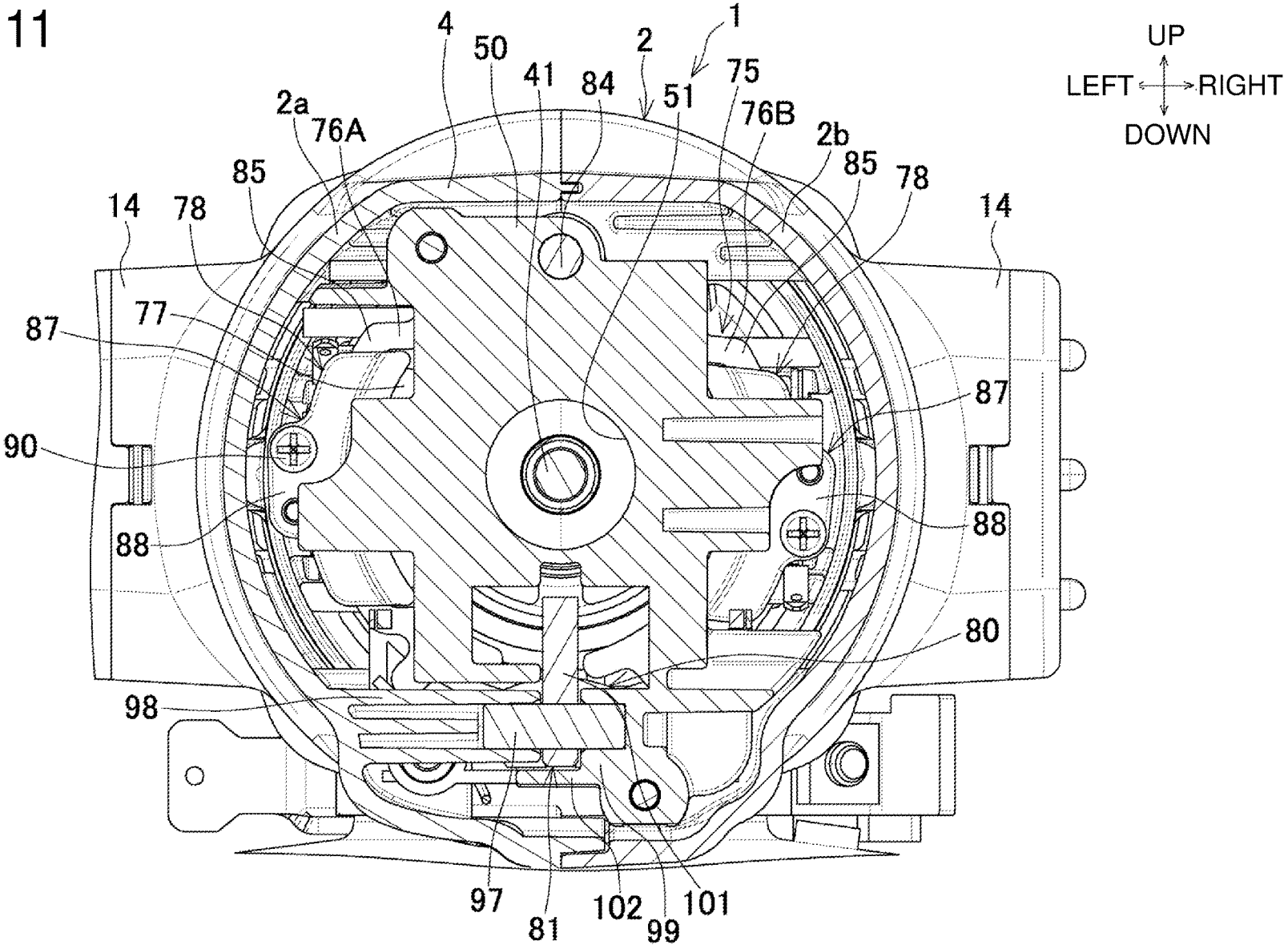
FIG. 11 is a sectional view taken along line D-D in FIG. 3.

The front link 81 is located below the magnet sleeve 44 and the brake drum 40 and at the middle in the lateral direction. The front link 81 is a strip plate bent into an L shape as viewed laterally. The front link 81 is located vertically below the cylindrical recess 51 in the coil holder 50. A support pin 97 extends laterally through a bend of the front link 81. The support pin 97 is supported by a receiving boss 98 protruding from the inner surface of the left housing half 2*a* as shown in FIG. 11. A pin receiver 99 positioning the right end of the support pin 97 is located in a lower portion of the coil holder 50 rightward from the front link 81.

The front link 81 is thus supported about the support pin 97 in a rotatable manner in the main housing 2.

The front link 81 includes a front arm 100 and a rear arm 101. The front arm 100 protrudes frontward from the support pin 97 and is placed in the connection groove 96 on the wedge plate 80. The rear arm 101 extends diagonally upward from the support pin 97 to the rear. As shown in FIG. 10, the front arm 100 is tapered, as is the connection groove 96, with the lateral width decreasing from its upper end toward its lower end in the cross section. With the front arm 100 fitted in the connection groove 96, the wedge plate 80 is connected to the front arm 100 while being prevented from slipping off upward, and moves up and down together with the front arm 100. The coil holder 50 includes, in its lower portion, a restrictor 102 restricting downward rotation of the front arm 100. As shown in FIGS. 3 and 10, the wedge plate 80 is at a lower limit position at the rotational position of the front link 81 at which the front arm 100 is closer to or in contact with the restrictor 102, or in other words, at a left rotational position of the front link 81 about the support pin 97 in FIG. 3. The wedge plate 80 at the lower limit position is away downward from the left and right lower ends of the brake arms 76A and 76B as indicated by the solid line in FIG. 10. The rear arm 101 has an elongated hole 103 elongated in the longitudinal direction in its upper end.

The rear link 82 includes a pair of left and right arms 105 and a connecting shaft 106. The pair of arms 105 are located on the left and right of the coil holder 50 and the controller 60. Each arm 105 extends in the front-rear direction. The arm 105 includes a rear portion bent toward the middle in the lateral direction to protrude into the grip 5 to have a shorter distance between the left and right arms 105. The arm 105 has its rear end connected to the connecting pin 74 in the switch lever 8 in a rotatable manner. The arm 105 has a pivot hole 107 elongated in the longitudinal direction at the middle. Support bosses 108 protrude from the left and right sides of the coil holder 50. The support bosses 108 each have a distal end engaged with the corresponding pivot hole 107.

The connecting shaft 106 extends laterally. The connecting shaft 106 extends through the elongated hole 103 in the rear arm 101 in the front link 81. The connecting shaft 106 has its left and right ends connected to the front ends of the arms 105 in a rotatable manner.

Figure 12:
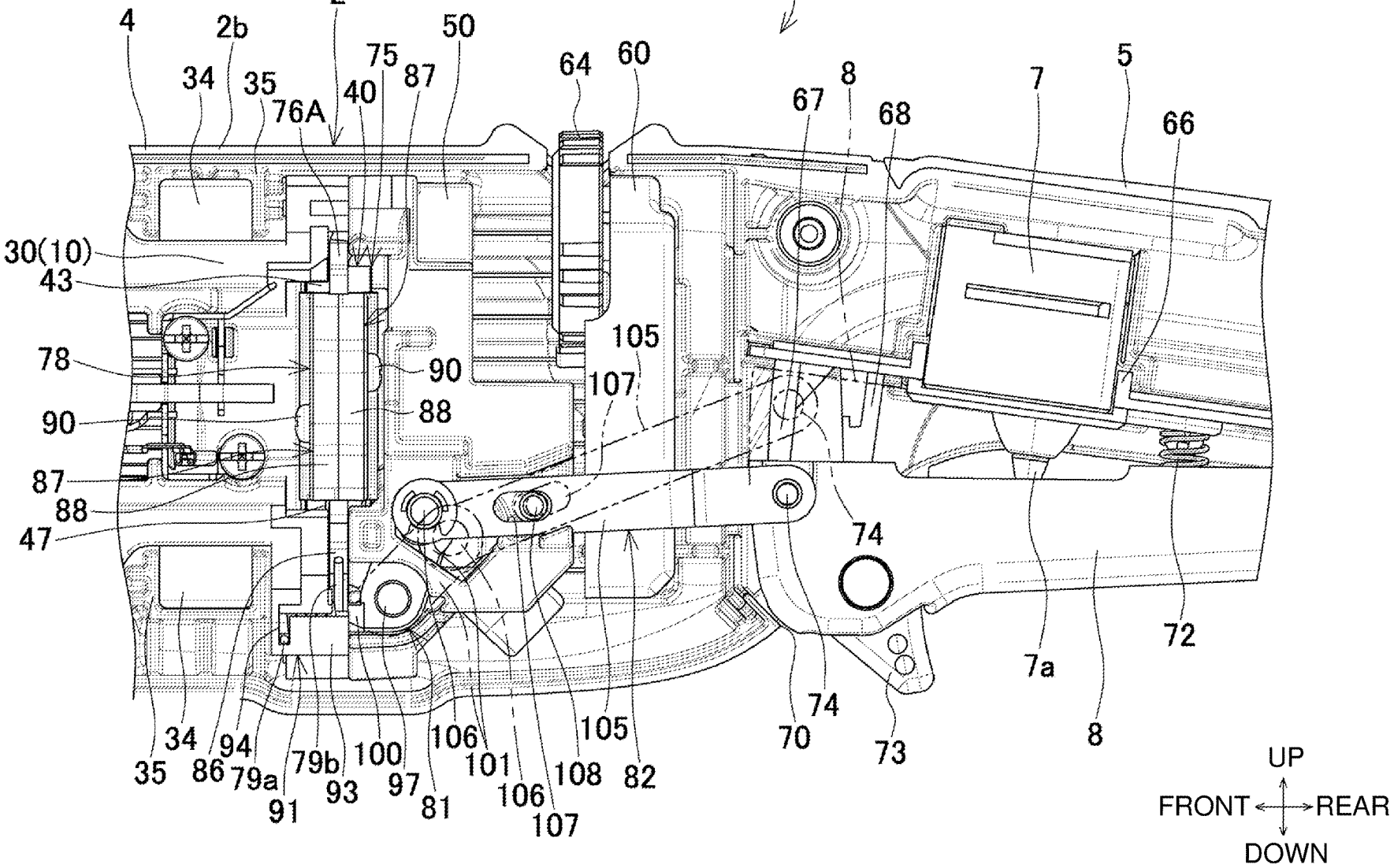
FIG. 12 is a side view of the brake assembly without showing the left housing half in the switch-off state.

With the switch lever 8 at the lower position, each arm 105 has a substantially horizontal orientation with the support boss 108 located rearward in the pivot hole 107 as indicated by the solid line in FIG. 12. The connecting shaft 106 is at a forward position, and the front link 81 is at the left rotational position. The wedge plate 80 is thus at the lower limit position below the brake arms 76A and 76B as shown in FIG. 10.

When the switch lever 8 swings to the upper position as indicated by the two-dot-dash line in FIG. 12, the connecting pin 74 moves upward. The rear end of each arm 105 is then pulled upward together with the connecting pin 74 as indicated by the two-dot-dash line. This causes the corresponding support boss 108 to move relatively within the pivot hole 107 and the arm 105 to rotate substantially about the support boss 108 to the left. The front end of the arm 105 thus moves downward together with the connecting shaft 106 while moving backward. The front link 81 then rotates to the right about the support pin 97 and lifts the front arm 100. The wedge plate 80 is thus at the upper limit position at which the wedge plate 80 is placed between the lower ends of the brake arms 76A and 76B as indicated by the two-dot-dash lines in FIG. 10.

In the brake assembly 75 with the switch 7 being off in the grinder 1, the brake shoes 77 press, in the lateral direction, the outer circumference surface of the rim 43 on the brake drum 40, which rotates integrally with the rotational shaft 17. Braking is thus applied to the rotational shaft 17 through the brake drum 40.

The switch lever 8 is then pressed with the hand holding the grip 5. Then, as indicated by the two-dot-dash line in FIG. 12, the switch lever 8 swings to the upper position to press the button 7*a*, turning on the switch 7. The controller 60 then energizes the motor 16.

In response to the switch lever 8 swinging to the upper position, the arm 105 in the rear link 82 rotates to the left to rotate the front link 81 to the right, moving the wedge plate 80 to the upper position. As indicated by the two-dot-dash lines in FIG. 10, the brake arms 76A and 76B then rotate outward to the left and right about the pivot pin 84 to separate the brake shoes 77 from the rim 43 on the brake drum 40. The rotational shaft 17 is thus released from braking and rotates. The rotation of the rotational shaft 17 is transmitted to the spindle 23 through the bevel gears 21 and 24, thus rotating the tip tool 28.

The fan 19 rotates as the rotational shaft 17 rotates. This causes outside air to be sucked in through the inlets 6 in the body 4. The sucked air passes through the controller 60 and the coil holder 50 in this order. The air then flows between the spokes 42 in the brake drum 40 and through radially outside the rim 43 to the motor 16. The air then passes through the motor 16 and flows through the gear housing cover 12 to be discharged through the outlets 20. This air flow cools the controller 60, the coil holder 50, the brake drum 40, and the motor 16.

In particular, heat is dissipated from the entire rim 43 on the brake drum 40, effectively cooling the brake drum 40 together with the airflow in contact with the brake drum 40. Although dust or other matter can be produced from the brake shoes 77, such dust may be blown forward by the airflow and is less likely to adhere to the outer circumferential surface of the rim 43. Dust or other matter in the groove 47 is discharged forward or backward along the groove 47 as the brake drum 40 rotates.

When the switch lever 8 is released from being pressed, the coil spring 72 urges the switch lever 8 to swing to the lower position. The button 7*a* is thus released from being pressed to turn off the switch 7.

In response to the switch lever 8 swinging to the lower position, the rear link 82 moves forward to the position shown in FIG. 3 and indicated by the solid line in FIG. 12 while rotating to the right substantially about the support boss 108. The front link 81 then rotates to the left about the support pin 97 and swings the front arm 100 downward. The wedge plate 80 thus moves to the lower limit position indicated by the solid line in FIG. 10 to be removed from between the lower ends of the brake arms 76A and 76B. The brake arms 76A and 76B then rotate toward the middle in the lateral direction under an urging force from the torsion springs 79, causing the brake shoes 77 to press the outer circumference surface of the rim 43 on the brake drum 40. Braking is thus applied to the rotational shaft 17 through the brake drum 40, and the braking force is transmitted to the spindle 23 to stop the tip tool 28.

During braking, the brake shoes 77 press, from radially outward positions, the rim 43 with a larger diameter than the rotational shaft 17. In other words, the brake shoes 77 indirectly apply braking to the rotational shaft 17 from positions radially apart from the axis of the rotational shaft 17. This boosts the pressing forces to allow a higher braking force to be applied with a lower pressing force. The groove 47 reduces dust or other matter accumulating on the outer circumferential surface of the rim 43. The braking force is thus efficiently transmitted from the brake shoes 77 to the rim 43, without the braking performance being affected.

Figure 13:
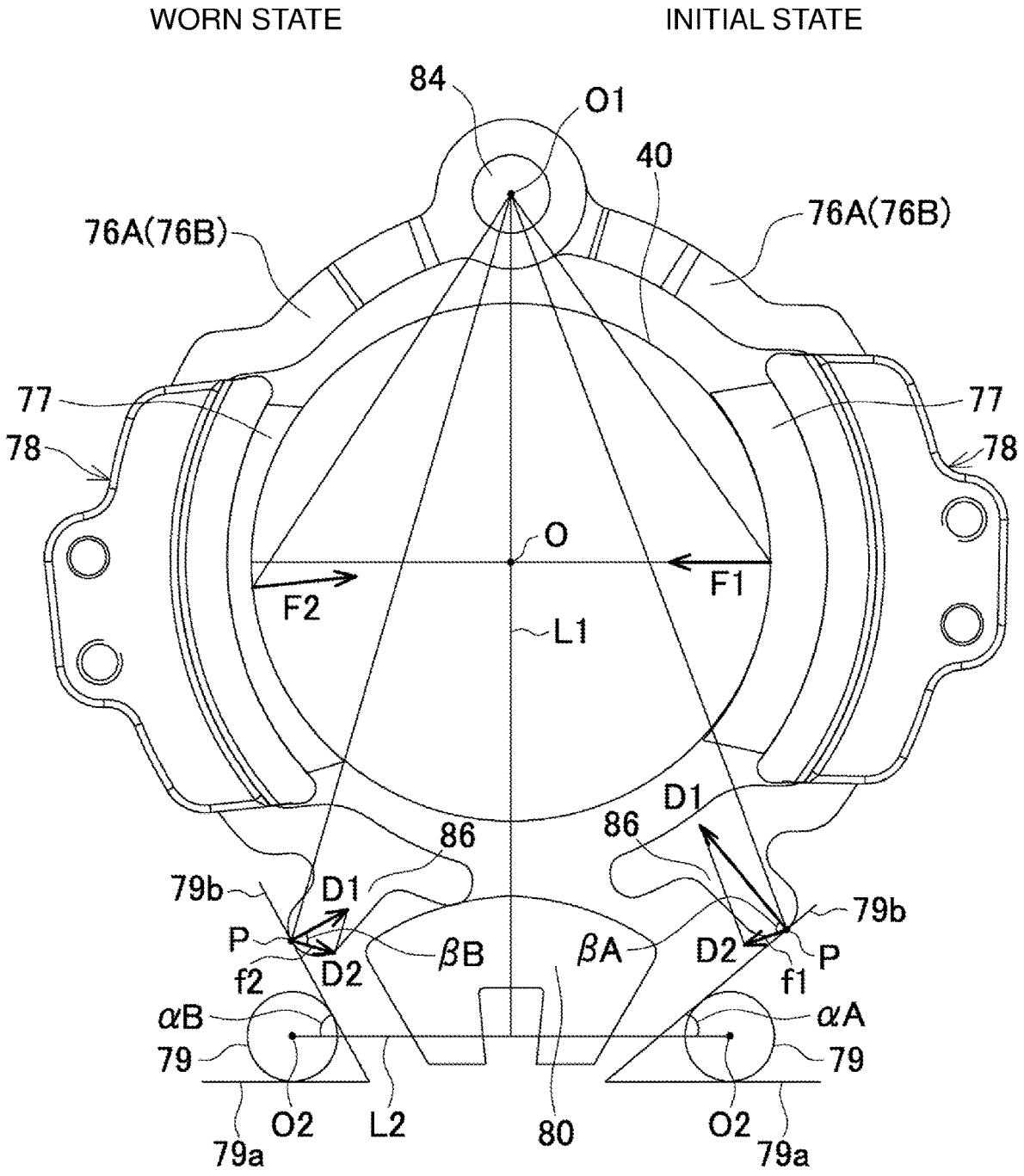
FIG. 13 is a schematic diagram showing the positions of brake arms during braking when brake shoes are in an initial state or in a worn state.

The brake shoes 77 wears as they are used over time. FIG. 13 is a schematic diagram showing the positions of the brake arms 76A and 76B during braking when the brake shoes 77 are in an initial state or in a worn state. FIG. 13 shows the initial state on the right and the worn state on the left.

As shown in FIG. 13, a line L2 is orthogonal to the line L1 extending through the axial center O1 of the pivot pin 84 and extends through the axial center O2 of each torsion spring 79. The left or right movable end 79*b* defines an angle α between the movable end 79*b* and the line L2. The angle α in the initial state is referred to as an angle αA, and the angle α in the worn state as an angle αB. In this case, αA<αB. The angle α defined with each movable end 79*b* increases as the brake shoes 77 wear. In other words, as the corresponding brake shoe 77 wears, the position P at which each movable end 79*b* is in contact with the protrusion 86 approaches the axial center O2 of the corresponding torsion spring 79 in the direction along the line L2.

The direction in which the movable end 79*b* presses the protrusion 86, or in other words, an action direction D1 in which an elastic force is applied, defines an angle β at the position P with a swing direction D2 in which the brake arm 76A or 76B swings (a tangential direction to the swing trajectory) about the pivot pin 84. As the angle α defined with the movable end 79*b* changes, the angle β changes. The angle β in the initial state is referred to as an angle βA, and the angle α in the worn state as an angle βB. In this case, βA>βB. In other words, when the brake shoe 77 wears and the angle α defined with the movable end 79*b* decreases, a force component f2 in the swing direction D2 in the worn state becomes larger than a force component f1 in the swing direction D2 in the initial state. The elastic force from the movable ends 79*b* is transmitted to the brake arms 76A and 76B efficiently.

When the brake shoes 77 wear, the position of the axial center O2 of the torsion spring 79 and the spring constant are thus adjusted to apply braking to the brake drum 40 with a pressing force F2 being substantially equivalent to a pressing force F1 from the brake shoes 77 in the initial state.

As described above, the grinder 1 includes the main housing 2 (housing), the switch 7 in the main housing 2 operable to be turned on or off in response to an operation on the switch lever 8 (operable member), the rotational shaft 17 rotatable in response to an operation to turn on the switch 7, and the brake assembly 75 that applies braking to the rotational shaft 17 with the switch 7 being in an off state and releases the braking applied to the rotational shaft 17 in response to the operation on the switch lever 8 to turn on the switch 7. The brake drum 40 (brake member) having a circular outer shape is coaxially fixed to the rotational shaft 17. The brake assembly 75 includes the brake arms 76A and 76B (swing member) swingable about the axial center O1 (first decentered position) decentered from the axial center O of the brake drum 40, the brake shoes 77 (press member) held by the brake arms 76A and 76B to come in contact with the brake drum 40 in response to the brake arms 76A and 76B swinging, and the torsion springs 79 (spring) each having the axial center O2 at a second decentered position opposite to the axial center O1 with the axial center O of the brake drum 40 between the axial center O2 and the axial center O. The axial centers O2 are on the line L2 (second line) orthogonal to the line L1 (first line) extending through the center O of the brake drum 40 and the axial center O1. The torsion springs 79 each have an elastic movable end 79*b* in contact with the end of the brake arm 76A or 76B. The torsion springs 79 urge the brake arms 76A and 76B to the positions at which the brake shoes 77 are in contact with the brake drum 40 with the switch 7 being in the off state.

This structure causes the movable ends 79*b* of the torsion springs 79 to urge the ends of the brake arms 76A and 76B swinging about the axial center O1 to apply braking. This can reduce a decrease in the braking force and prevent a delay in the stop time of the tip tool 28 when the brake shoes 77 wear over time.

The angle α between each movable end 79*b* and the line L2 changes in response to the corresponding brake shoe 77 increasingly wearing.

The elastic force from the movable ends 79*b* can thus be transmitted efficiently to the brake arms 76A and 76B in response to the brake shoes 77 increasingly wearing.

The angle β defined between the action direction D1 in which the elastic force is applied from each movable end 79*b* toward the corresponding brake arm 76A or 76B and the swing direction D2 in which the end of the brake arm 76A or 76B swings in response to the corresponding brake shoe 77 increasingly wearing.

The force component of the elastic force in the swing direction D2 thus increases in response to the brake shoe 77 increasingly wearing.

The position P at which each movable end 79*b* is in contact with the end of the corresponding brake arm 76A or 76B approaches the axial center O2 in the direction along the line L2 in response to the corresponding brake shoe 77 increasingly wearing.

The elastic force from the movable ends 79*b* can thus be effectively transmitted in the rotational direction of the brake arms 76A and 76B.

The end of each of the brake arms 76A and 76B includes a protrusion 86 in contact with the corresponding movable end 79*b*.

The elastic force can thus be transmitted from the movable ends 79*b* to the brake arms 76A and 76B without transmission loss.

The protrusion 86 in contact with the movable end 79*b* has a curved outer surface.

The brake arms 76A and 76B can thus swing smoothly, and the angle α defined with each movable end 79*b* can change smoothly.

The pair of brake arms 76A and 76B are located on opposite sides of the axial center O of the brake drum 40, and the pair of torsion springs 79 are located on the opposite sides of the axial center O of the brake drum 40, as viewed in the axial direction of the rotational shaft 17.

This allows applying and releasing of braking in a balanced manner.

Each torsion spring 79 has the axial center O2 closer to, in the direction along the line L2, the line L1 than the position P at which the movable end 79*b* is in contact with the end of the corresponding brake arm 76A or 76B.

The braking force is thus easily adjustable in the initial state or in the worn state.

The brake assembly 75 causes, in response to the operation on the switch lever 8 to turn on the switch 7, the brake arms 76A and 76B to swing in the direction in which the brake shoes 77 separate from the brake drum 40 to release the braking applied to the rotational shaft 17.

The braking applied to the rotational shaft 17 by the brake arms 76A and 76B is thus released easily.

The brake assembly 75 includes the wedge plate 80 (wedge) to be in contact with the brake arms 76A and 76B in response to the operation on the switch lever 8 to turn on the switch 7 and to cause the brake arms 76A and 76B to swing in the directions in which the brake shoes 77 separate from the brake drum 40.

The wedge plate 80 thus allows reliable release of the braking applied to the rotational shaft 17 by the brake arms 76A and 76B.

Modifications of the present disclosure will now be described.

The positions of the torsion springs are not limited to the example in the embodiment and can be changed as appropriate to any positions at which the torsion springs are in contact with the ends of the brake arms and can urge the brake arms toward the brake drum. The movable ends may have a different length as appropriate. The torsion springs may be held in the bearing retainer in a manner different from the manner in the embodiment.

The springs are not limited to the torsion springs in the embodiment. The torsion springs may have more turns or fewer turns than in the embodiment.

The springs may have movable ends formed by coiling a plate material, rather than a wire material.

The springs may be leaf springs not wound into coils. Leaf springs may each be bent into an L shape to have one end as a fixed end and the other end as a movable end.

The brake arms may each eliminate the protrusion in the embodiment and have the end without the protrusion in contact with the movable end of the spring.

The swing members may each eliminate the raised portion as in the brake arms in the embodiment and have a shape still closer to an arc. The swing members may be bent along the periphery of the brake members or may be straight.

The swing members may each have a pivot below or lateral to the drum brake, instead of above the brake drum as in the embodiment.

The swing members may not be a pair. The swing member may be, for example, a single member.

The press member may not be located for each swing member, unlike the brake shoes in the embodiment. Each swing member may include two or more brake shoes that can each come in contact with or separate from the brake member from a radially outward position. The press members may be held in any manner other than with the shoe holders in the embodiment. The press members may be held with, for example, a pair of clamping plates hinged together.

The press members may be directly attached to the swing members by, for example, bonding.

The shape of the brake member may be modified as appropriate. The brake drum in the embodiment may include, for example, more or fewer spokes, or the hub or the rim with a different shape.

The brake member is not limited to the brake drum in the embodiment, but may be a single disk. The groove on the outer circumferential surface may include multiple grooves or may be eliminated. The brake member may be fastened to the rotational shaft in any manner other than by screwing.

In the embodiment, the brake arms are placed outside the brake drum and are swingable about the pivot to cause the movable ends of the torsion springs to be in contact with the ends of the brake arms from radially outside positions. However, braking may be applied in the opposite manner. More specifically, a cylindrical brake member coaxially connected to the rotational shaft may include a swing member including a press member and attached through the opening of the brake member in a manner swingable about a pivot. A spring may be located radially inward on an end of the swing member with its movable end being in contact with the end of the swing member from inside to urge the swing member radially outward to swing. In this case, the press member in the swing member urged to swing radially outward comes in contact with the inner surface of the brake member to apply braking.

The wedge may not be the wedge plate in the embodiment. For example, the wedge may be tapered, or more specifically, trapezoidal or triangular, with a lateral width decreasing upward, instead of having a fan-shaped upper portion as in the embodiment. The wedge may be connected to the front link with, for example, a pin, in place of a tapered connection groove.

The wedge may be a block, such as a cone, in place of a plate. The wedge may be placed into or removed from between the holding members in the front-rear direction, rather than in the radial direction.

The holding members and the wedge may be positioned in the front-rear direction without using the motor housing and the coil holder, unlike in the embodiment. Other components in the main housing may be used to position the holding members and the wedge. The holding members and the wedge may be positioned without using components but using, for example, ribs protruding into the housing.

The link members may have any structure other than the front link and the rear link in the embodiment. For example, the front arm in the front link may be integral with a portion corresponding to the wedge. The front link may include a pair of arms. The rear link may not include a pair of arms when the structure does not include the component such as a controller.

The link members may include three or more link members.

The power tool may be a direct current (DC) tool powered by a battery pack, rather than an alternating current (AC) tool using utility power.

The power tool may be a device other than a grinder. The structure according to embodiments of the present disclosure is applicable to any tool that includes a brake assembly applying braking to a rotational shaft that rotates a tip tool, for example, a grinding tool or a polishing tool (e.g., a polisher or a sander), or a cutting tool (e.g., a circular saw or a cutter). The brake assembly may be used to apply braking to a rotational shaft other than a rotational shaft in a motor.

The power tool is not limited to an electric tool. The structure according to embodiments of the present disclosure is also applicable to an air tool or an engine tool.

REFERENCE SIGNS LIST

1 grinder
2 main housing
3 gear housing
4 body
5 grip
7 switch
8 switch lever
10 motor housing
16 motor
17 rotational shaft
19 fan
23 spindle
28 tip tool
30 bearing retainer
40 brake drum

41 hub
43 rim
47 groove
50 coil holder
60 controller
74 connecting pin
75 brake assembly
76A, 76B brake arm
77 brake shoe
78 shoe holder
79 torsion spring
79*a* fixed end
79*b* movable end
80 wedge plate
81 front link
82 rear link
83 pivot portion
84 pivot pin
85 raised portion
87 clamping plate
91 spring holder
95 extension
96 connection groove
97 support pin
100 front arm
101 rear arm
105 arm
106 connecting shaft
O axial center of brake drum
O1 axial center of pivot pin
O2 axial center of torsion spring
L1 line extending through axial center O and axial center O1
L2 line orthogonal to line L1
α angle between movable end and line L2
β angle between action direction D1 in which elastic force is applied from movable end and
swing direction D2 in which end of brake arm swings
P position at which movable end is in contact with protrusion

What is claimed is:

1. A power tool, comprising:
a housing;
a switch in the housing, the switch being operable to be turned on or off in response to an operation on an operable member;
a rotational shaft rotatable in response to an operation to turn on the switch;
a brake member having a circular outer shape and coaxially fixed to the rotational shaft; and
a brake assembly configured to apply braking to the rotational shaft with the switch being in an off state and to release the braking applied to the rotational shaft in response to the operation on the operable member to turn on the switch, the brake assembly including;
a swing member swingable about a pivot at a first decentered position decentered from a center of the brake member,
a press member held by the swing member, the press member being configured to come in contact with the brake member in response to the swing member swinging, and
a spring having a center at a second decentered position opposite to the pivot with the center of the brake member between the center of the spring and the pivot, the center of the spring being on a second line orthogonal to a first line extending through the center of the brake member and the pivot, the spring having a movable end being elastic and in contact with an end of the swing member, the spring being configured to urge the swing member to a braking position at which the press member is in contact with the brake member with the switch being in the off state.

2. The power tool according to claim 1, wherein
the movable end defines an angle between the movable end and the second line, and the angle changes in response to the press member increasingly wearing.

3. The power tool according to claim 2, wherein
the movable end applies an elastic force toward the swing member in an action direction, the end of the swing member swings in a swing direction, the action direction and the swing direction define an angle, and the angle between the action direction and the swing direction decreases in response to the press member increasingly wearing.

4. The power tool according to claim 2, wherein
the movable end is in contact with the swing member at a contact position, and the contact position approaches the center of the spring at the second decentered position in a direction along the second line in response to the press member increasingly wearing.

5. The power tool according to claim 1, wherein
the end of the swing member includes a protrusion in contact with the movable end.

6. The power tool according to claim 5, wherein
the protrusion in contact with the movable end has a curved outer surface.

7. The power tool according to claim 1, wherein
a pair of the swing members are located on opposite sides of the center of the brake member, and a pair of the springs are located on the opposite sides of the center of the brake member, as viewed in an axial direction of the rotational shaft.

8. The power tool according to claim 1, wherein
the spring is a torsion spring, and
in an initial state, the torsion spring has a center closer to the first line, in a direction along the second line, compared to a contact position at which the movable end is in contact with the end of the swing member.

9. The power tool according to claim 1, wherein
the brake assembly causes, in response to the operation on the operable member to turn on the switch, the swing member to swing in a direction in which the press member separates from the brake member to release the braking applied to the rotational shaft.

10. The power tool according to claim 9, wherein
the brake assembly includes a wedge configured to be in contact with the swing member in response to the operation on the operable member to turn on the switch and to cause the swing member to swing in the direction in which the press member separates from the brake member.

11. The power tool according to claim 3, wherein
the movable end is in contact with the swing member at a contact position, and the contact position approaches the center of the spring at the second decentered position in a direction along the second line in response to the press member increasingly wearing.

12. The power tool according to claim 2, wherein
the end of the swing member includes a protrusion in contact with the movable end.

13. The power tool according to claim 3, wherein
the end of the swing member includes a protrusion in contact with the movable end.

14. The power tool according to claim 4, wherein the end of the swing member includes a protrusion in contact with the movable end.

15. The power tool according to claim 2, wherein a pair of the swing members are located on opposite sides of the center of the brake member, and a pair of the springs are located on the opposite sides of the center of the brake member, as viewed in an axial direction of the rotational shaft.

16. The power tool according to claim 3, wherein a pair of the swing members are located on opposite sides of the center of the brake member, and a pair of the springs are located on the opposite sides of the center of the brake member, as viewed in an axial direction of the rotational shaft.

17. The power tool according to claim 4, wherein a pair of the swing members are located on opposite sides of the center of the brake member, and a pair of the springs are located on the opposite sides of the center of the brake member, as viewed in an axial direction of the rotational shaft.

18. The power tool according to claim 5, wherein a pair of the swing members are located on opposite sides of the center of the brake member, and a pair of the springs are located on the opposite sides of the center of the brake member, as viewed in an axial direction of the rotational shaft.

19. The power tool according to claim 6, wherein a pair of the swing members are located on opposite sides of the center of the brake member, and a pair of the springs are located on the opposite sides of the center of the brake member, as viewed in an axial direction of the rotational shaft.

20. The power tool according to claim 2, wherein the spring is a torsion spring, and in an initial state the torsion spring has a center closer to the first line, in a direction along the second line, compared to a contact position at which the movable end is in contact with the end of the swing member.

* * * * *